US008534995B2

(12) United States Patent
McCaffrey

(10) Patent No.: US 8,534,995 B2
(45) Date of Patent: Sep. 17, 2013

(54) TURBINE ENGINE SEALING ARRANGEMENT

(75) Inventor: Michael G. McCaffrey, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 368 days.

(21) Appl. No.: 12/398,990

(22) Filed: Mar. 5, 2009

(65) Prior Publication Data

US 2010/0226760 A1 Sep. 9, 2010

(51) Int. Cl.
*F01D 11/08* (2006.01)
*F01D 5/20* (2006.01)

(52) U.S. Cl.
USPC ..... 415/173.1; 415/173.3; 416/191

(58) Field of Classification Search
USPC ..... 415/173.1, 173.3, 174.2, 196, 197; 416/191, 198, 198 R; 277/416
See application file for complete search history.

(56) References Cited

U.S. PATENT DOCUMENTS

| | | | | | |
|---|---|---|---|---|---|
| 3,085,398 | A | * | 4/1963 | Ingleson | 415/127 |
| 3,123,187 | A | * | 3/1964 | Welsh | 403/252 |
| 4,066,384 | A | * | 1/1978 | DiFerdinando | 416/189 |
| 4,087,199 | A | | 5/1978 | Hemsworth et al. | |
| 4,247,248 | A | | 1/1981 | Chaplin et al. | |
| 4,289,446 | A | | 9/1981 | Wallace | |
| 4,422,648 | A | | 12/1983 | Eaton et al. | |
| 4,596,116 | A | * | 6/1986 | Mandet et al. | 60/785 |
| 4,676,715 | A | | 6/1987 | Imbault et al. | |
| 5,044,881 | A | * | 9/1991 | Dodd et al. | 415/173.3 |
| 5,188,507 | A | * | 2/1993 | Sweeney | 415/173.1 |
| 5,429,478 | A | * | 7/1995 | Krizan et al. | 415/173.7 |
| 5,474,417 | A | * | 12/1995 | Privett et al. | 415/58.5 |
| 5,609,469 | A | | 3/1997 | Worley et al. | |
| 6,113,349 | A | | 9/2000 | Bagepalli et al. | |
| 6,368,054 | B1 | * | 4/2002 | Lucas | 415/135 |
| 6,638,012 | B2 | * | 10/2003 | Bekrenev | 415/115 |
| 6,679,679 | B1 | * | 1/2004 | Debeneix et al. | 415/139 |
| 6,726,448 | B2 | | 4/2004 | McGrath et al. | |
| 6,733,233 | B2 | | 5/2004 | Jasklowski et al. | |
| 6,932,566 | B2 | | 8/2005 | Suzumura et al. | |
| 7,278,820 | B2 | | 10/2007 | Keller | |
| 7,908,867 | B2 | * | 3/2011 | Keller et al. | 60/753 |
| 2003/0198750 | A1 | * | 10/2003 | Skoog et al. | 427/376.6 |
| 2003/0207155 | A1 | * | 11/2003 | Morrison et al. | 428/699 |
| 2005/0002779 | A1 | * | 1/2005 | Tanaka | 415/173.1 |
| 2005/0220610 | A1 | * | 10/2005 | Ghasripoor et al. | 415/173.3 |
| 2006/0228211 | A1 | * | 10/2006 | Vance et al. | 415/200 |
| 2007/0212217 | A1 | * | 9/2007 | Northfield | 415/200 |
| 2008/0089787 | A1 | | 4/2008 | Abdel-Messeh et al. | |
| 2009/0317286 | A1 | * | 12/2009 | Nishi | 420/440 |

* cited by examiner

*Primary Examiner* — Caridad Everhart
(74) *Attorney, Agent, or Firm* — Carlson, Gaskey & Olds P.C.

(57) ABSTRACT

An example turbine engine sealing arrangement includes a blade array rotatable about an axis. The blade array has a plurality of blades extending radially from the axis. A control ring is circumferentially disposed about the blade array. A plurality of tiles are secured relative to the control ring and configured to establish an axially extending seal with one of the blades.

21 Claims, 3 Drawing Sheets

TURBINE ENGINE SEALING ARRANGEMENT

BACKGROUND

This application relates generally to an arrangement of gas turbine engine components that facilitates sealing a turbine engine.

Gas turbine engines are known and typically include multiple sections, such as a fan section, a compression section, a combustor section, a turbine section, and an exhaust nozzle section. The compressor and turbine sections include blade arrays mounted for a rotation about an engine axis. The blade arrays include multiple individual blades that extend radially from a mounting platform to a blade tip.

Rotating the blade arrays compresses air in the compression section. The compressed air mixes with fuel and is combusted in the combustor section. The products of combustion expand to rotatably drive blade arrays in the turbine section. The tips of the individual blades within the rotating blade arrays each establish a seal with another portion of the engine, such as an engine control ring or a blade outer air seal, at a seal interface. The sealing relationship between the individual blade and the other portion of the engine facilitates compression of the air and expansion of the products of combustion. Maintaining the integrity of the components near the sealing interface helps maintain the sealing relationship.

As known, cooling air removes thermal byproducts from the engine, but many components are still exposed to extreme temperatures and temperature variations. Exposing a single monolithic component to varied temperatures can result in uneven expansion of that component, which can affect the integrity of that component by, for example, disrupting the mounting of the component or causing the component to fracture. Disadvantageously, components made of materials capable of withstanding extremely high temperatures often fail when exposed to varied temperatures, and components made of materials capable of withstanding varied temperatures often fail when exposed to extreme temperatures.

SUMMARY

An example turbine engine sealing arrangement includes a blade array rotatable about an axis. The blade array has a plurality of blades extending radially from the axis. A control ring is circumferentially disposed about the blade array. A plurality of tiles are secured relative to the control ring and configured to establish an axially extending seal with one of the blades.

Another example turbine engine cladding arrangement includes a first tile mountable to a control ring of a turbine engine and a second tile mountable to the control ring. The first tile is configured to be positioned axially adjacent to the second tile in the turbine engine. The first tile and the second tile together provide a portion of a sealing interface with a blade of the turbine engine.

A method of sealing a portion of a turbine engine includes securing a first tile relative to a control ring and securing a second tile relative to a control ring. The second tile is positioned axially adjacent the first tile. The method includes establishing a seal with a blade using the first tile and the second tile.

These and other features of the example disclosure can be best understood from the following specification and drawings, the following of which is a brief description.

DETAILED DESCRIPTION

Figure 1:
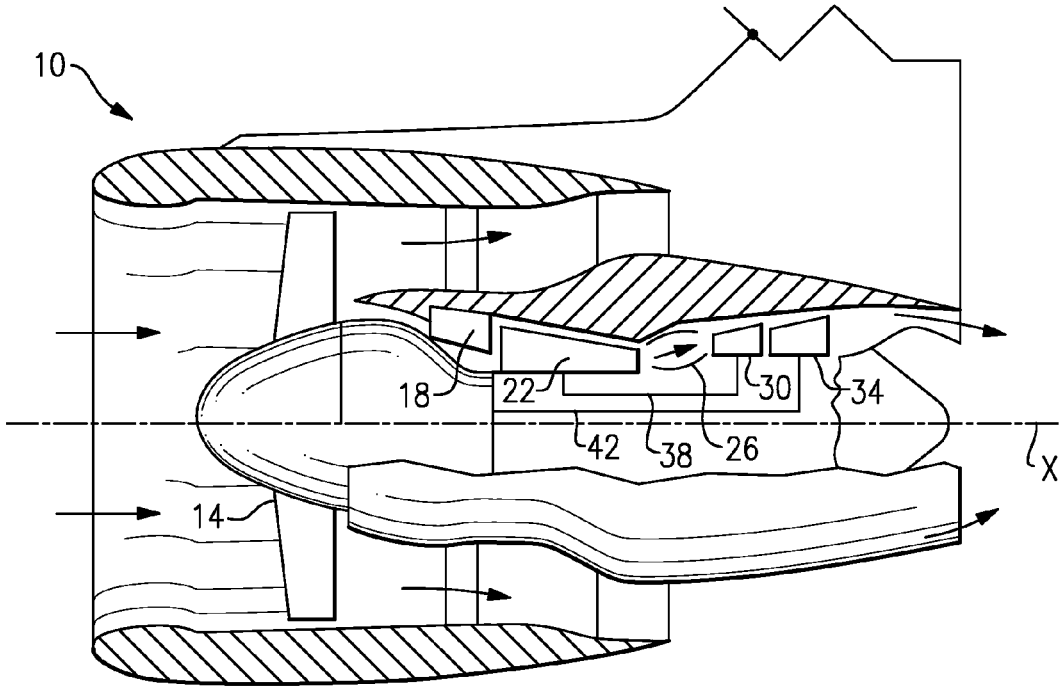
FIG. 1 shows a schematic view of an example gas turbine engine.

FIG. 1 schematically illustrates an example gas turbine engine 10 including (in serial flow communication) a fan section 14, a low-pressure compressor 18, a high-pressure compressor 22, a combustor 26, a high-pressure turbine 30, and a low-pressure turbine 34. The gas turbine engine 10 is circumferentially disposed about an engine centerline X. During operation, air is pulled into the gas turbine engine 10 by the fan section 14, pressurized by the compressors 18 and 22, mixed with fuel, and burned in the combustor 26. The turbines 30 and 34 extract energy from the hot combustion gases flowing from the combustor 26.

In a two-spool design, the high-pressure turbine 30 utilizes the extracted energy from the hot combustion gases to power the high-pressure compressor 22 through a high speed shaft 38. The low-pressure turbine 34 utilizes the extracted energy from the hot combustion gases to power the low-pressure compressor 18 and the fan section 14 through a low speed shaft 42. The examples described in this disclosure are not limited to the two-spool engine architecture described and may be used in other architectures, such as a single-spool axial design, a three-spool axial design, and still other architectures. That is, there are various types of engines that could benefit from the examples disclosed herein, which are not limited to the design shown.

Figure 2:
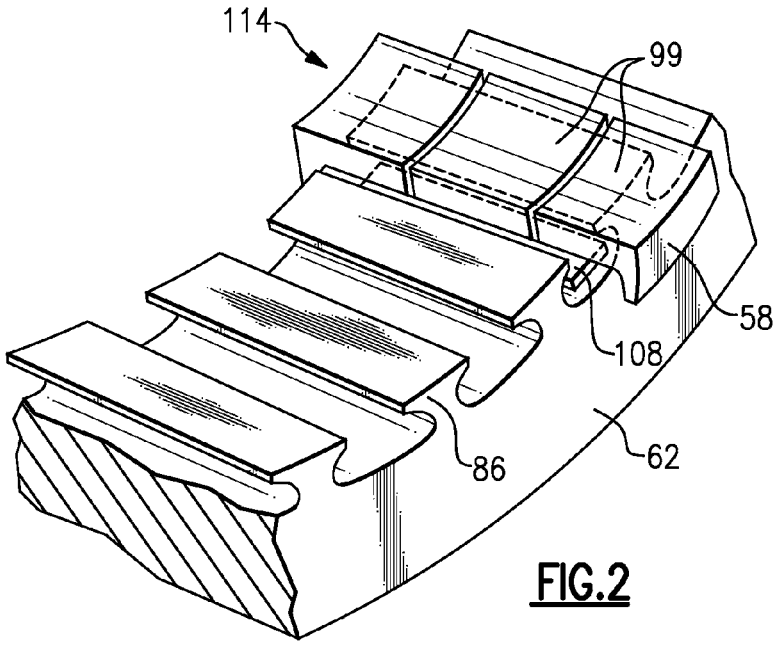
FIG. 2 shows a perspective view of a portion of a sealing arrangement from the FIG. 1 engine.
Figure 3:
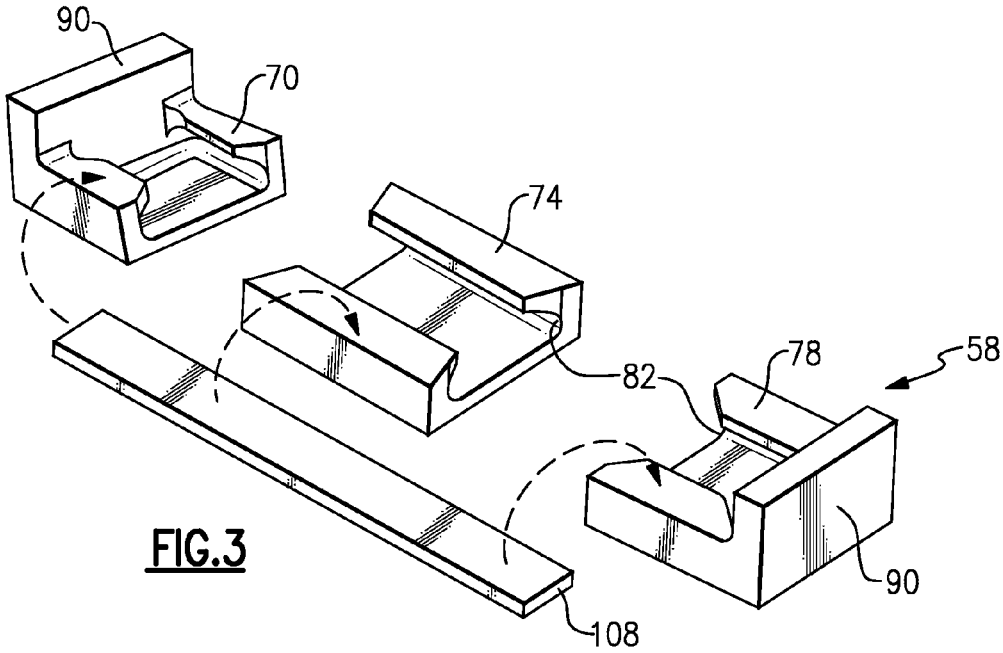
FIG. 3 shows an exploded view of a cladding and a seal from the FIG. 2 sealing arrangement.
Figure 4:
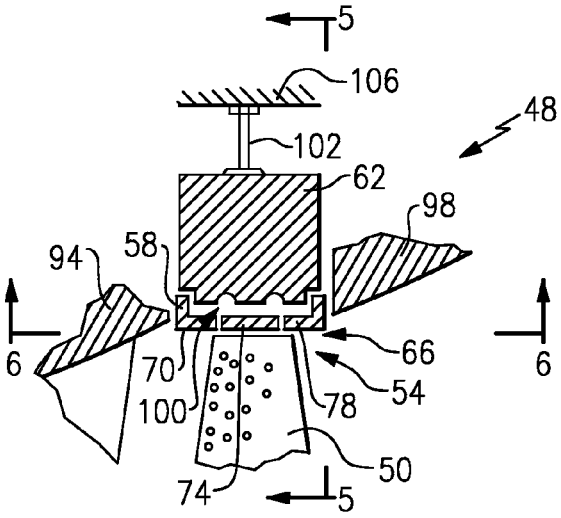
FIG. 4 shows a section view through the sealing arrangement portion of the FIG. 1 engine.
Figure 5:
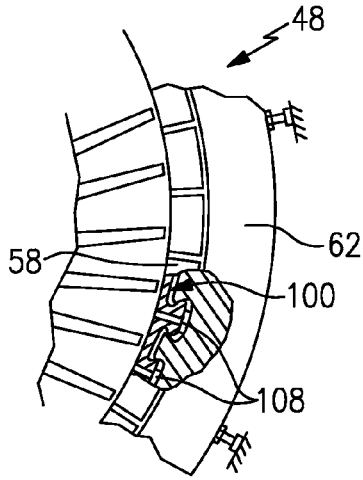
FIG. 5 shows a section view at line 5-5 of FIG. 4 having a cutaway portion.

Referring now to FIGS. 2-4 with continuing reference to FIG. 1, an example sealing arrangement 48 within the engine 10 includes a blade 50 having a blade tip portion 54 that is configured to seal against a cladding 58 carried by a control ring 62. A sealing interface 66 is established between the blade tip 54 and the cladding 58 when the blade tip 54 seals against the cladding 58. The example cladding 58 includes a first outer tile 70, an inner tile 74, and a second outer tile 78. Other examples include other arrangements of tiles.

In this example, the axial length of the sealing interface 66 generally corresponds to the axial length of the blade tip 54. The sealing interface 66 also axially extends from the first outer tile 70, across the inner tile 74, to the second outer tile 78. That is, the blade tip 54 is configured to establish the sealing interface 66 with cladding 58 having multiple individual tiles, rather than a single tile.

The example cladding 58 is ceramic. In another example, one or more of the first outer tile 70, the inner tile 74, or the second outer tile 78 have another composition, such as a ceramic matrix composite.

To hold the position of the cladding 58, the example cladding 58 slidingly engages the control ring 62. More specifically, in this example, the cladding 58 establishes a groove 82 that is operative to receive a corresponding extension 86 of the control ring 62. The first outer tile 70 and the second outer tile 78 further include a flange 90 directed radially outward that act as stops to limit axial movements of the cladding 58 relative to the control ring 62.

In this example, securing the cladding 58 relative to the control ring 62 involves first sliding the inner tile 74 axially such that the extension 86 of the control ring 62 is received within the groove 82 of the inner tile 74. Next, the first outer tile 70 and the second outer tile 78 are slid over corresponding portions of the extension 86.

As can be appreciated from the figures, the example extension 86 and the example groove 82 have a tongue and groove type relationship that limits relative radial movement between the cladding 58 and the control ring 62 when the extension 86 is received within the groove 82. In another example, the control ring 62 establishes a groove operative to receive an extension of the cladding.

Other portions of the engine 10, such as a vane section 94 upstream from the control ring 62 limit axial movement of the cladding 58 away from the control ring 62. In one example, a portion 98 of the engine 10 is spring loaded such that the portion 98 biases the cladding 58 in an upstream direction toward the vane section 94.

The example inner tile 74 and outer tiles 70 and 78 each include a surface 99 facing the blade tip 54 that is about 2-3 centimeters by 2-3 centimeters. The minimum depth of the inner tile 74 and outer tiles 70 and 78 is about 1 centimeter, for example.

In this example, a plurality of hangers 102 extend from an outer casing 106 of the engine 10 to hold the control ring 62 within the engine 10. The hangers 102 are circumferentially disposed about the control ring 62. In one example, the control ring 62 is made of a ceramic material. In another example, the control ring 62 comprises a ceramic metal composite. Cooling airflow moves between the outer casing 106 and the control ring 62 as is known.

Portions of the cladding 58 are radially spaced from the control ring 62 when the extension 86 is received within the groove 82 to provide a cleared area 100 between the control ring 62 and the cladding 58. In some examples, no cooling airflow near the sealing interface 66 is required, which forces the cladding 58 to operate in a higher temperature environment. The cladding 58 is still able to seal with the blade 50 in such an environment at least because the cladding 58 withstands the higher temperatures more effectively than a monolithic structure. In one example, cooling airflow moves to the cleared area 100 to cool the sealing interface 66, especially the cladding 58.

A seal plate 108 provides a seal near the cleared area 100 that blocks flow of air between the cleared area 100 and another portion of the engine 10. Compression forces within the engine 10 force the seal plate 108 radially inward against the control ring 62 and the cladding, which enhances the effectiveness of the associated seal. In one example, the seal is a cobalt alloy seal. Other examples may include a ceramic matrix composite seal.

In this example, the cladding 58 is arranged in axially extending rows 114 on the control ring 62. The example seal 108 extends axially to contact each of the first outer tile 70, the inner tile 74, and the second outer tile 78 of the cladding 58. The example rows 114 are circumferentially distributed around the control ring 62.

Figure 6A:
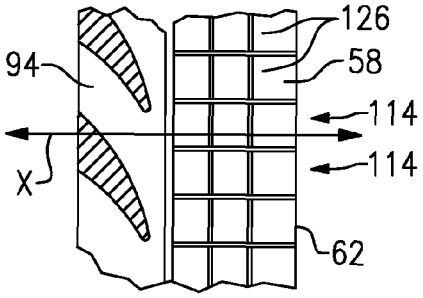
FIG. 6A shows a section view at line 6-6 of FIG. 4 showing an example cladding arrangement.
Figure 6B:
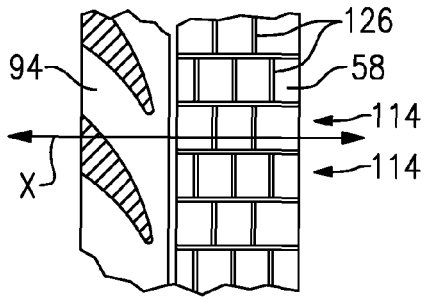
FIG. 6B shows a section view at line 6-6 of FIG. 4 showing an alternative cladding arrangement.

In the FIG. 6A example, the inner tile 74 meets the first outer tile 70 and the second outer tile 78 at tile interfaces 126, which are aligned with the tile interfaces 126 of adjacent rows 114. In the FIG. 6B example, some of the rows 114 include two inner tiles 74, and the tile interfaces 126 of adjacent rows 114 are staggered. In both the FIGS. 6A and 6B examples, the rows are generally aligned with the engine centerline X.

Figure 6C:
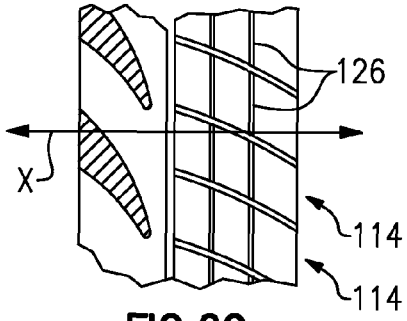
FIG. 6C shows a section view at line 6-6 of FIG. 4 showing another alternative cladding arrangement.
Figure 6D:
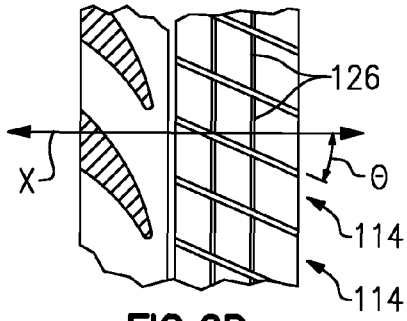
FIG. 6D shows a section view at line 6-6 of FIG. 4 showing yet another alternative cladding arrangement.

In the FIG. 6C example, the rows 114 extend in an arc relative to the engine centerline X. In the FIG. 6D example, the rows 114 are disposed at an angle θ relative to the engine centerline X. Other examples include other arrangements of the cladding 58.

Figure 7:
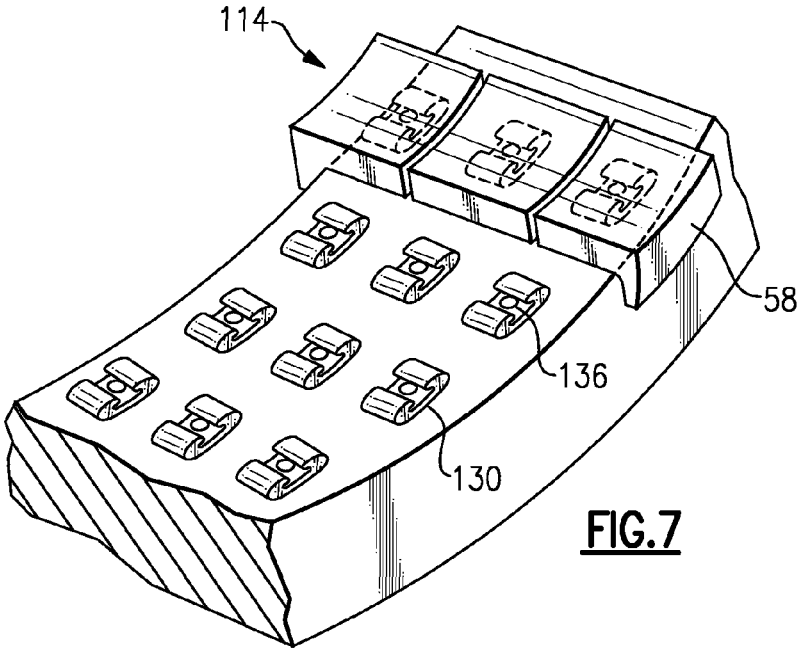
FIG. 7 shows a perspective view of an alternative sealing arrangement from the FIG. 1 engine.

As shown in FIG. 7, in some examples, a plurality of clips 130 are secured to the control ring 136 and the cladding 58 is slidingly received over the clips 130, rather than the extension 86 (FIG. 2) to hold the cladding 58 relative to the control ring 136.

Features of the disclosed examples include using cladding consisting of multiple components, such as tiles, to provide a sealing interface with a blade rather than a cladding consisting of a single monolithic structure that can crack in response to temperature variations. Another feature of the disclosed example is simplified method of securing the cladding relative to other portions of an engine. Yet another feature is to size the tiles such that internal flaws created during manufacturing are minimized, and process yields are increased.

Although an exemplary embodiment has been disclosed, a worker of ordinary skill in this art would recognize that certain modifications would come within the scope of this invention. For that reason, the following claims should be studied to determine the true scope and content of this invention.

I claim:

1. A turbine engine sealing arrangement, comprising:

a blade array rotatable about an axis, the blade array having a plurality of blades extending radially from the axis;

a control ring circumferentially disposed about the blade array; and a plurality of tiles secured relative to the control ring, the plurality of tiles together establishing an axially extending seal with one of the plurality of blades as the one of the blades is rotated relative to the plurality of tiles from a circumferential end portion of the plurality of tiles to an opposing circumferential end portion of the plurality of tiles, wherein each of the plurality of tiles is separate and distinct from other tiles within the plurality of tiles, wherein the plurality of tiles comprises at least one inner tile and at least two outer tiles, the at least one inner tile configured to be secured relative to the control ring axially between opposing ones of the at least two outer tiles.

2. The arrangement of claim 1, wherein the plurality of tiles comprise ceramic tiles that are separate and distinct from the control ring.

3. The arrangement of claim 1, wherein the plurality of tiles are separately slidingly engageable with the control ring.

4. The arrangement of claim 1, including a plurality of clips circumferentially disposed about the axis and configured to hold the plurality of tiles relative to the control ring.

5. The arrangement of claim 1, including a vane structure that limits axial movement of the plurality of tiles relative to the control ring, wherein the plurality of tiles are axially biased toward an upstream direction of the engine.

6. The arrangement of claim 1, wherein the plurality of blades is not directly connected to any of the plurality of tiles.

7. The arrangement of claim 1, wherein the axially extending seal is entirely radially aligned.

8. The arrangement of claim 1, wherein the axially extending seal extends further in an axial direction than in a circumferential direction.

9. The arrangement of claim 1, wherein a continuous sealing interface associated with the one of the plurality of blades extends from a portion of a first tile of the plurality of tiles to a portion of a second tile of the plurality of tiles, the first tile axially spaced from the second tile.

10. The arrangement of claim 9, wherein the first tile and the second tile are arranged in one of a plurality of axially extending rows of tiles that are circumferentially disposed about the blade array, wherein a tile interface between the first tile and the second tile is axially offset relative to a tile interface in another of the axially extending rows.

11. The arrangement of claim 9, wherein the first tile contacts the second tile.

12. The arrangement of claim 1, including a seal plate at axially extending interface between each of the plurality of tiles and the control ring.

13. The arrangement of claim 12, wherein the seal plate comprises a cobalt alloy.

14. A turbine engine cladding arrangement, comprising:

a first tile mountable to a control ring of a turbine engine; and a second tile mountable to the control ring, wherein the first tile is configured to be positioned axially adjacent to the second tile in the turbine engine, and the first tile and the second tile together provide a portion of a sealing interface with a blade of the turbine engine as the blade is rotated relative to the first tile and the second tile, wherein the first tile is positioned axially between the second tile and a third tile.

15. The arrangement of claim 14, wherein at least one of the first tile or the second tile is axially smaller than the blade.

16. The arrangement of claim 14, wherein at least one of the first tile or the second tile comprises a ceramic material.

17. The sealing arrangement of claim 14, wherein at least one of the first tile and the control ring establishes a groove operative to slidingly receive a corresponding extension from the other of the first tile and the control ring, and at least one of the second tile and the control ring establishes a groove operative to slidingly receive a corresponding extension from the other of the first tile and the control ring.

18. The sealing arrangement of claim 14, wherein the second tile comprises a radially extending portion configured to limit axial movement of the second tile relative to the control ring.

19. The arrangement of claim 14, wherein the first tile is positioned upstream from the second tile relative a direction of flow through the turbine engine.

20. The arrangement of claim 14, wherein the sealing interface extends from the first tile to the second tile.

21. The arrangement of claim 14, wherein the sealing interface extends further in an axial direction than in a circumferential direction.

* * * * *